US005980272A

United States Patent [19]

McHugh et al.

[11] Patent Number: 5,980,272

[45] Date of Patent: Nov. 9, 1999

[54] ELECTRICAL CONNECTOR WITH BACK SHELL FOR CONTACT TAILS

[75] Inventors: Robert G. McHugh, Evergreen, Colo.; Wen-Chun Pei, Taiepi, Taiwan

[73] Assignee: Hon Hai Precision Ind. Co., Ltd., Taipei Hsien, Taiwan

[21] Appl. No.: 08/955,444

[22] Filed: Oct. 21, 1997

[51] Int. Cl.[6] ..... H01R 9/09

[52] U.S. Cl. ..... 439/79

[58] Field of Search ..... 439/79, 59, 78, 439/55

[56] References Cited

U.S. PATENT DOCUMENTS

| | | | |
|---|---|---|---|
| 4,640,562 | 2/1987 | Shoemaker | 439/77 |
| 5,090,116 | 2/1992 | Henschen et al. | 29/827 |
| 5,096,428 | 3/1992 | Lwee et al. | 439/79 |
| 5,468,154 | 11/1995 | Yip et al. | 439/79 |
| 5,591,036 | 1/1997 | Doi et al. | 439/79 |
| 5,658,155 | 8/1997 | McFarlane et al. | 439/79 |
| 5,658,156 | 8/1997 | Henderson et al. | 439/79 |
| 5,688,130 | 11/1997 | Huang | 439/79 |
| 5,692,912 | 12/1997 | Nelson et al. | 439/79 |
| 5,713,746 | 2/1998 | Olson et al. | 439/79 |
| 5,785,537 | 7/1998 | Donahue et al. | 439/79 |

*Primary Examiner*—Neil Abrams
*Assistant Examiner*—Michael C. Zarroli

[57] ABSTRACT

A horizontal type card edge connector (10) includes an elongated insulative housing (12) defining a central slot (14) for receiving a module (500) therein. Two rows of passageways (16) are provided by two sides of the central slot (14) in the housing (12) for receiving therein a corresponding number of contacts (18) which are adapted to be engaged with the corresponding circuit pads on the module (500). Two end blocks (20) disposed at two opposite ends of the housing (12), extend in both downward and rearward directions to define a space therebetween whereby the right angle type contact tails (30) are positioned in the space. A back shell (70) with an L-shaped cross-sectional configuration is attached to the back side of the housing (12) by a pair of latch devices (76) thereof for protectively covering all the contact tails (30) thereunder, wherein the horizontal wall (74) and the vertical wall (72) of the back shell (70) are respectively supported by the top edge sections (81) and the back edge sections (80) of the end blocks (20).

10 Claims, 8 Drawing Sheets

ELECTRICAL CONNECTOR WITH BACK SHELL FOR CONTACT TAILS

BACKGROUND OF THE INVENTION

1. Field of The Invention

The invention relates to electrical connectors, and particularly to the electrical connector, which is adapted to be mounted on the PC board, with a back shell for protectively enclosing the contact tails of the connector.

2. The Related Art

It is known that the connectors used in the interior of the computer and adapted to be mounted on the internal PC board, may be categorized with two types wherein one is of the straight contact and the other is of the right angle contact. The former generally has a vertical type housing enclosing a plurality of vertical type contacts whereby the tail portions of the contacts may extend into the corresponding holes in the PC board on which the connector is mounted. The latter generally has a horizontal type housing with a plurality of horizontal type contacts therein whereby the tail portion of each contact further includes a right angle section to have its corresponding tip extend downward to the PC board on which the connector is mounted. It can be understood that the right angle type contact tail of the contact may use more material than that of the vertical type and certainly also have a significant exposed portion on the back side of the housing of the connector.

It is seen that such exposed portions of the contact tails may be easily damaged during the shipping or assembling process, for example, scratching of the plating layer on the surface of the contact tail, or tilting of the contact tail. Those defects may result in difficulties of assembling and poor soldering.

Therefore, it is desired to have a device adapted to protectively cover such exposed portions of the contact tails for the connector while not jeopardizing simplicity and/or economy of the original design. It is also noted that some I/O (Input/Output) connectors mounted to the backpanel of the computer case, may have an attached metal shield on the back side, for example, U.S. Pat. No. 5,161,999, while such metal shield on the back of the housing is required to have the complicated structures for implementation of both shielding and grounding and for compliance with the specific configuration of the connector housing. In contrast, because the invention is intended to be used with a card edge type connector on the mother board, grounding consideration is no longer a major factor, and an easy and inexpensive way to provide a protective shield around the back portion of the housing in compliance with the original standard dimension of the housing of the connector, is desired at present.

SUMMARY OF THE INVENTION

According to an aspect of the invention, a horizontal type card edge connector includes an elongated insulative housing defining a central slot for receiving a module therein. Two rows of passageways are provided by two sides of the central slot in the housing for receiving therein a corresponding number of contacts which are adapted to be engaged with the corresponding circuit pads on the module. Two end blocks disposed at two opposite ends of the housing, extend in both downward and rearward directions to define a space therebetween whereby the right angle type contact tails are positioned in the space. A back shell with an L-shaped cross-sectional configuration is attached to the back side of the housing by means of the latch device for protectively covering all the contact tails thereunder, wherein the horizontal wall and the vertical wall of the back shell are respectively supported by the top edge sections and the back edge sections of the end blocks.

A spacer is optionally provided on the rear portion of the housing and retainably sandwiched between the two end blocks wherein a plurality of holes extend therethrough in the vertical direction for aligning the contact tails with regard to the corresponding holes in the board.

DETAILED DESCRIPTION OF THE PREFERRED EMBODIMENTS

Figure 1:
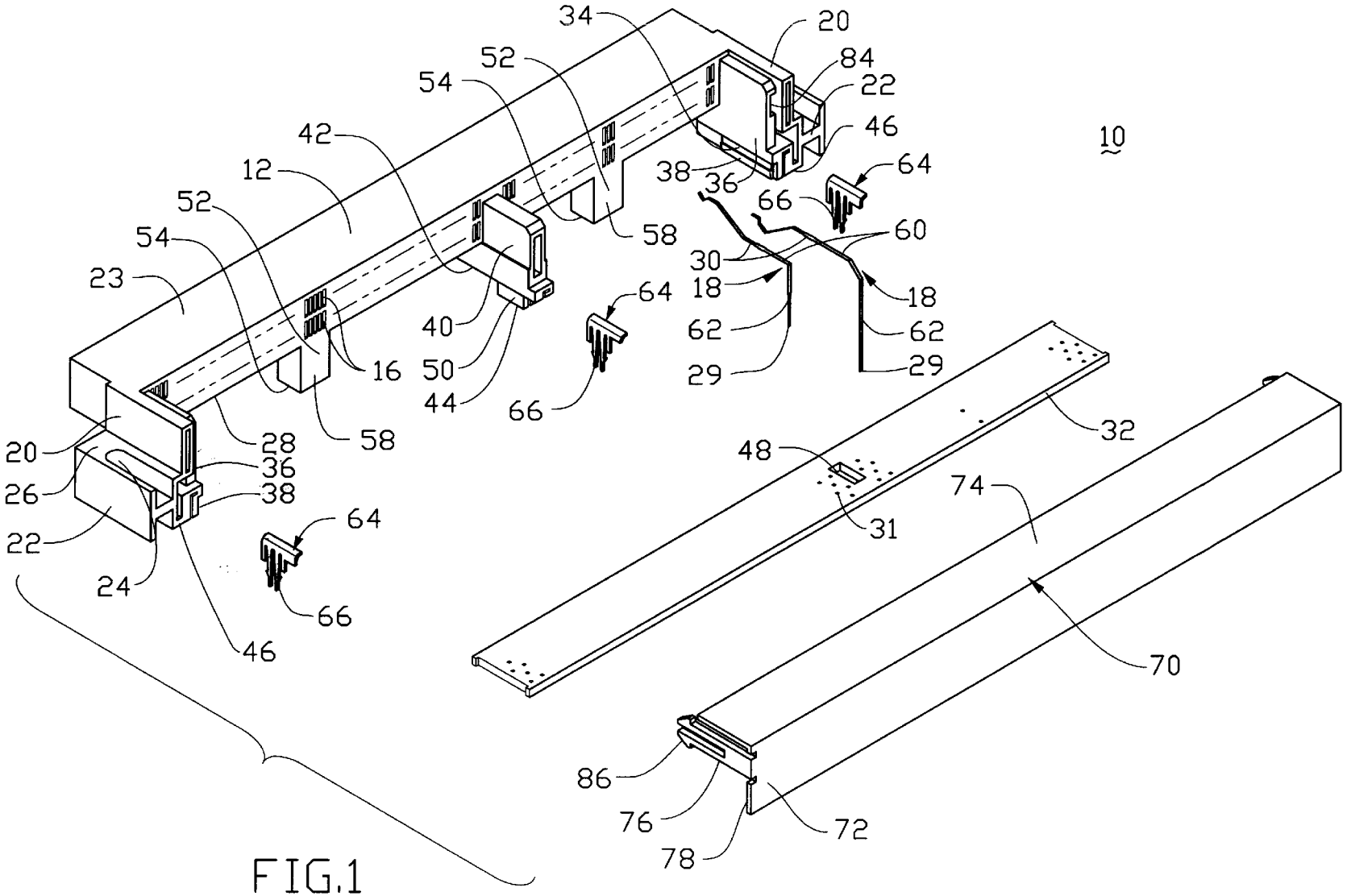
FIG. 1 is an exploded rear perspective view of a presently preferred embodiment of a horizontal type electrical connector, according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–6 wherein a horizontal type electrical connector 10 includes an insulative elongated housing 12 defining a central slot 14 along its longitudinal direction for receiving a module 500 (FIG. 6) therein. Provided by two sides of the central slot 14 are two rows of passageways 16 extending through the housing 12 in a front-to-back direction for receiving a corresponding number of contacts 18 therein, respectively.

A pair of end blocks 20 are positioned at two opposite ends of the housing 12. Each end block 20 extends downward and rearward so that the bottom surface 28 of the main body 23 of the housing 12 is spaced from a PC board 100 (FIG. 6), on which the connector 10 is seated, in a distance generally equal to the height of the housing 12 for facilitating insertion of a module 500 (FIG. 6) from a horizontal direction into the central slot 14 of the housing 12. Each block 20 further includes an outward horizontal extension 22 defining a screw hole 24 therein for allowing a screw (not shown) to extend therethrough and into the corresponding hole of the PC board 100 for securing the connector 10 to the PC board 100, wherein the top surface 26 of the extension 22 is generally at the same level with the bottom surface 28 of the main body 23 of the housing 12. Thus, the block 20 with the associated extension 22 function as a standoff with regard to the housing 12 of the connector 10.

Figure 1A:
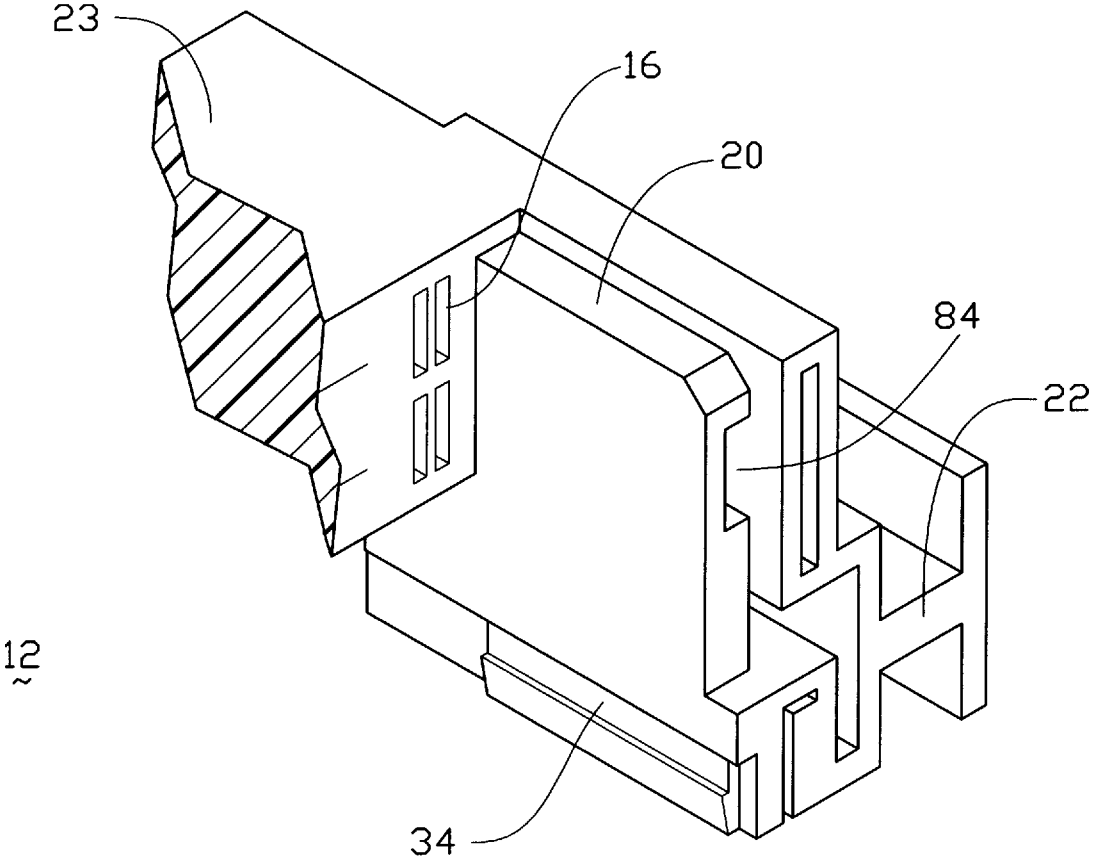
FIG. 1(A) is a partial perspective view of the housing of The connector of FIG. 1.
Figure 2:
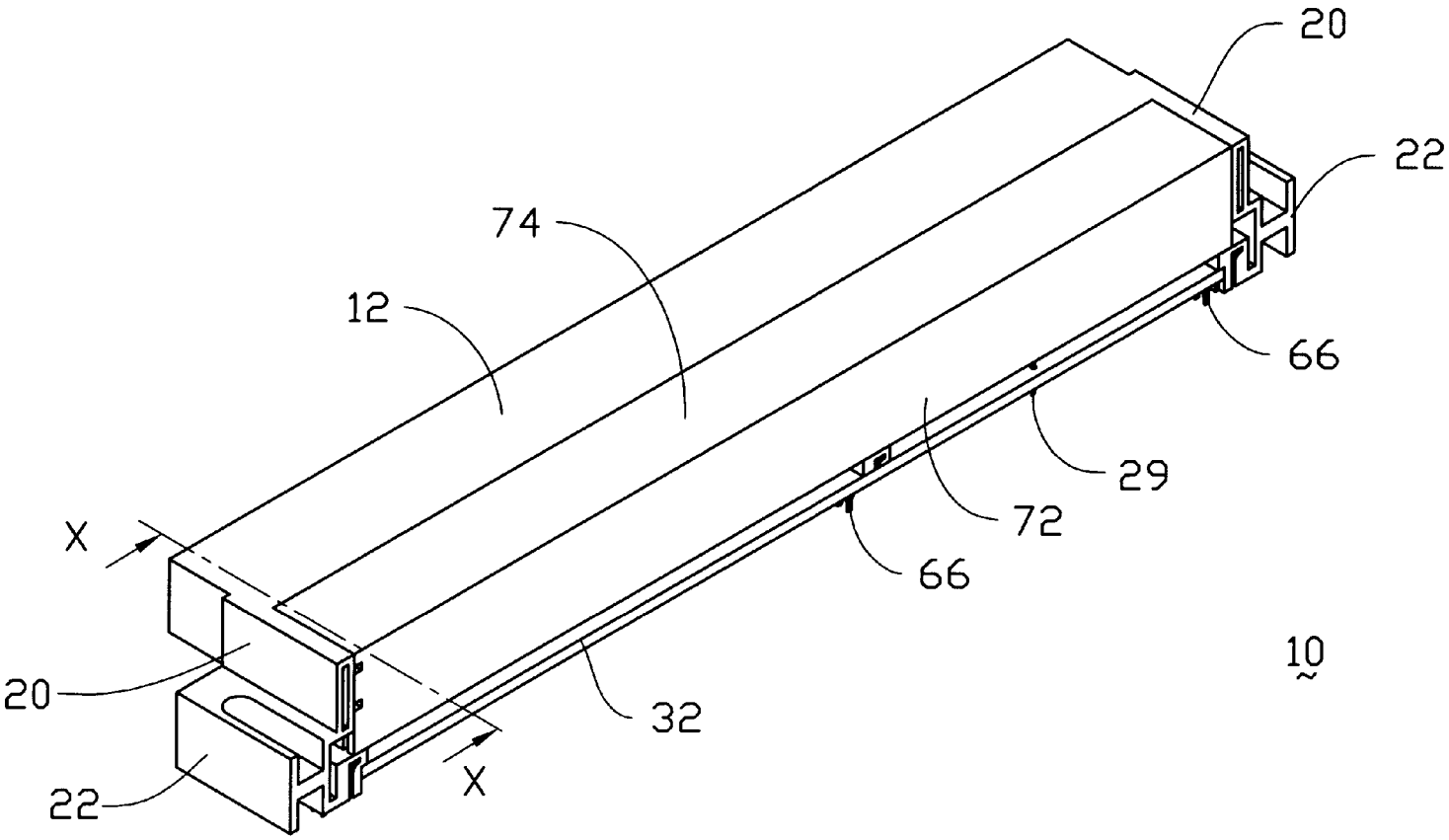
FIG. 2 is a rear perspective view of the assembled connector of FIG. 1.
Figure 3:
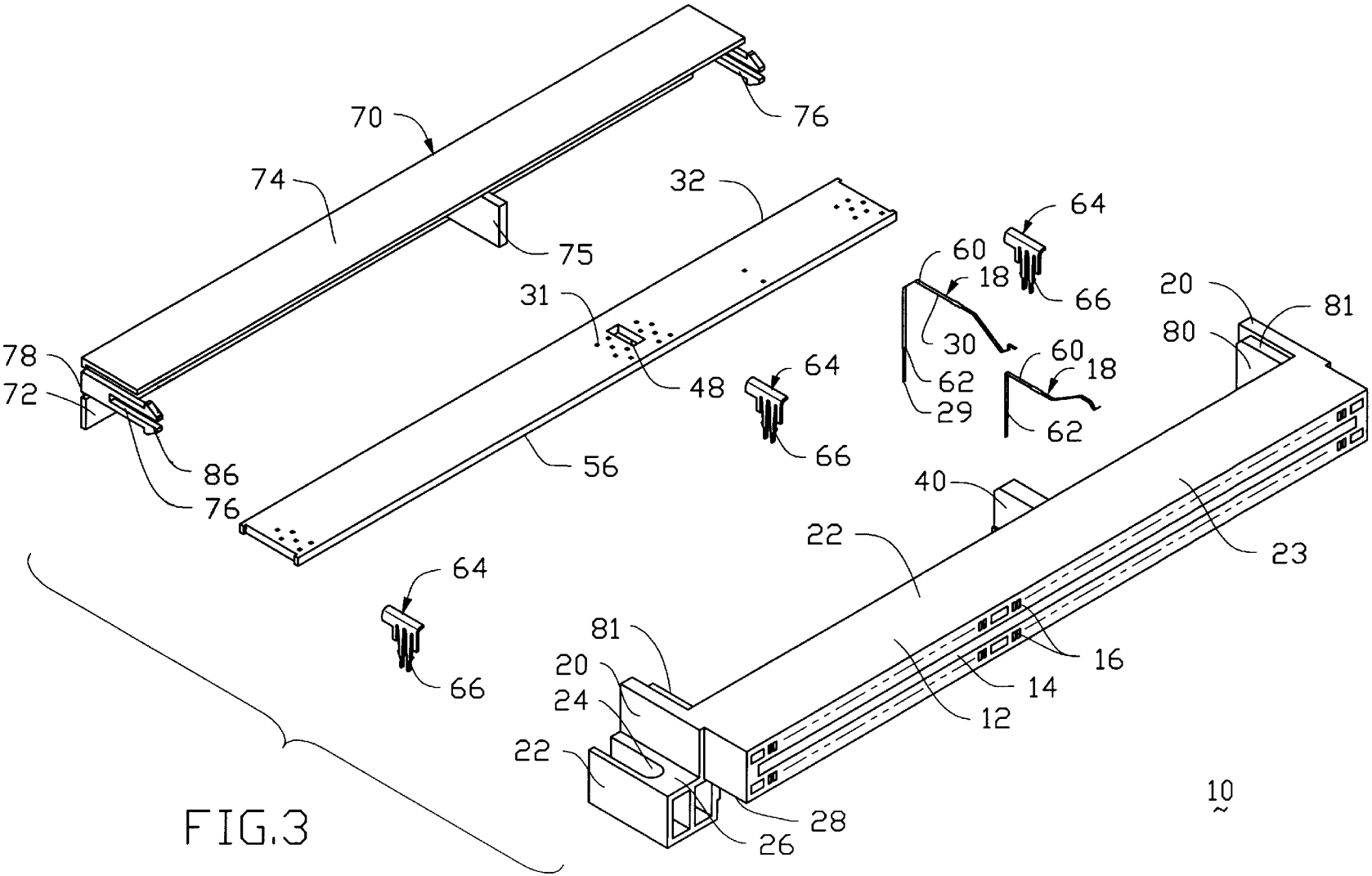
FIG. 3 is an exploded front perspective view of the connector of FIG. 1.
Figure 4:
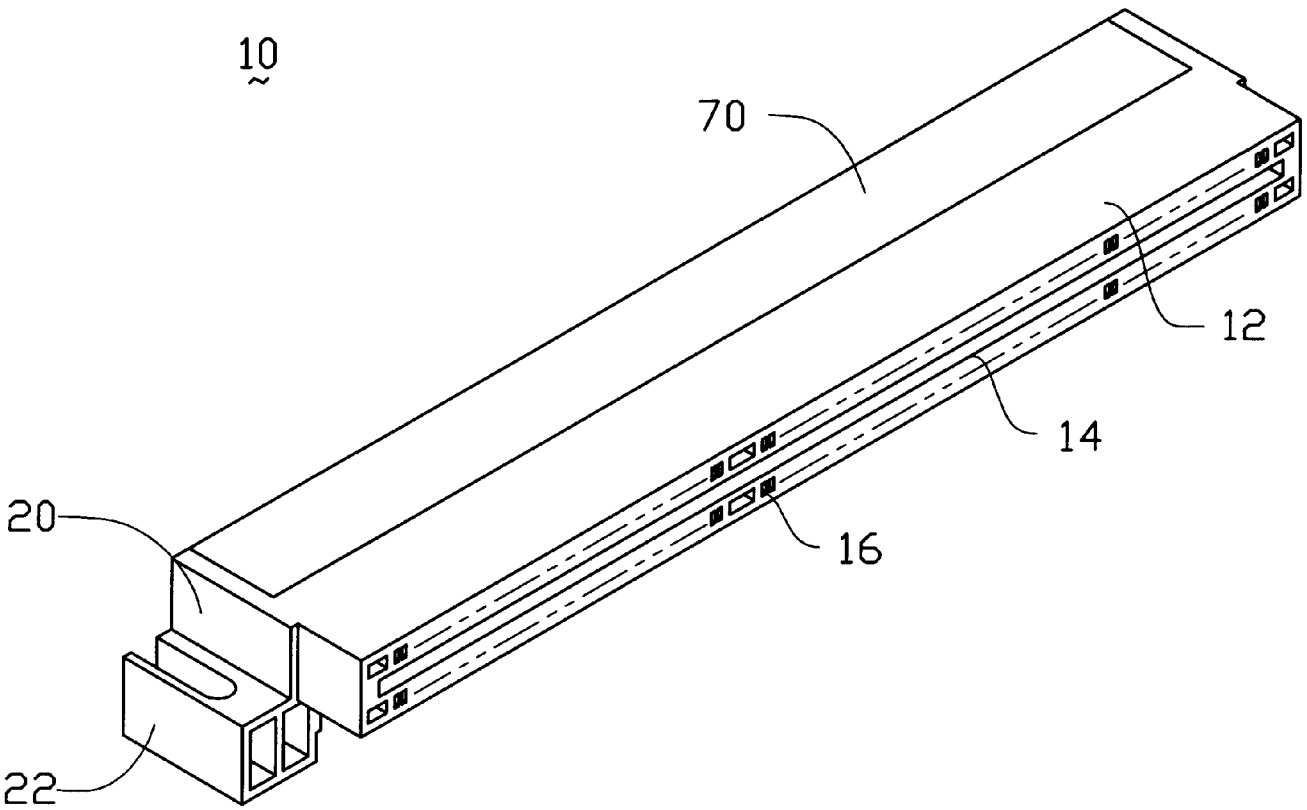
FIG. 4 is a rear perspective view of the assembled connector of FIG. 2.

Because the housing 12 of the horizontal type connector 10 has been raised away from the PC board 100 with a substantial distance generally equal to the height of the housing 12, the contact tail 30 of each contact 18 extends downward longer than the conventional one, which is substantially close to the PC board, for reaching the PC board 100 below. Accordingly, a spacer 32 is designedly disposed adjacent the bottom portions 38 of the blocks 20 and substantially in the space between the two blocks 20. To efficiently retain the spacer 32 in position regard to the blocks 20, a pair of shallow members 34 (FIG. 1(A)) are formed on the inner surface 36 of the bottom portion 38 of the blocks 20, respectively.

Additionally, because the spacer 32 extends along the longitudinal direction of the housing 12, and tends to be deflected around the middle portion thereof, an auxiliary block 40 is provided on the rear portion of the housing 12 whereby the spacer 32 may abut against the under-surface 42 of the auxiliary block 40. The auxiliary block 40 also includes a bottom surface 44 in coplanarity with the bottom surfaces 46 of the end blocks 20 for functioning as an additional standoff 50 for supportably mounting the connector 10 unto the PC board 100. It can be seen that the spacer 32 includes an aperture 48 to allow a standoff 50 to downward extend therethrough from the under-surface 42 of the auxiliary block 40 to the PC board 100. The spacer 32 can also be referred to U.S. patent application Ser. No. 08/955,769 of which the inventors and the assignee are the same to those of the present invention. A boardlock 64 is positioned in each block 20, 40 with an engagement section 66 extends downward out of the corresponding bottom surface 44, 46 of the block 40, 20 for engagement within the corresponding boardlock hole (not shown) in the board 100.

To achieve a more balanced arrangement along the longitudinal direction of the housing 12, two additional standoffs 52 are provided under the bottom surface 28 of the main body 22 of the housing 12 wherein each is positioned between the auxiliary block 40 and one corresponding end block 20 and has a bottom surface 54 in coplanarity with the bottom surface 46 of the end block 20. The front edge 56 of the spacer 32 confronts the back surface 58 of the standoff 52.

Because the contact tail 30 is of a right angle type generally positioned in the space between two end blocks 20 and having a significant rearward extending horizontal section 60 and successively a significant downward extending vertical section 62, an L-shaped cross-sectional shell 70 is provided to protectively cover the contact tail 30 without exposure to an exterior.

Figure 5:
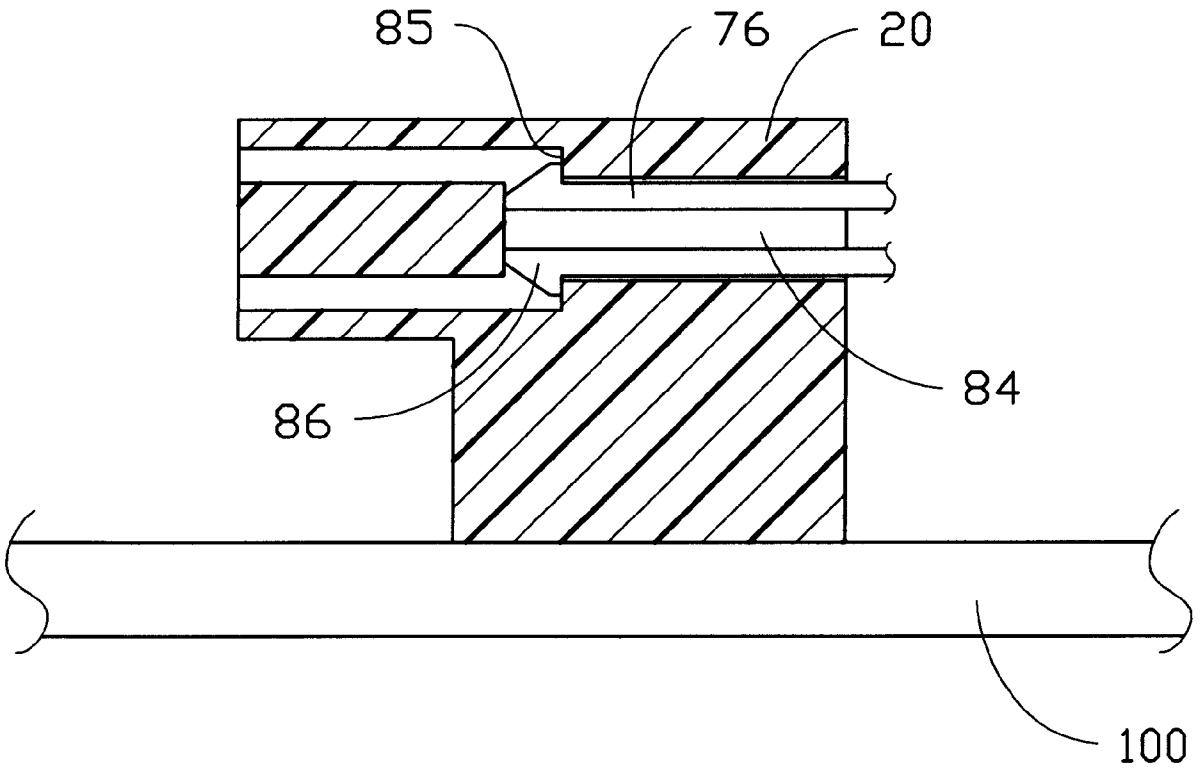
FIG. 5 is a cross-sectional view along line X—X of the connector of FIG. 2.
Figure 6:
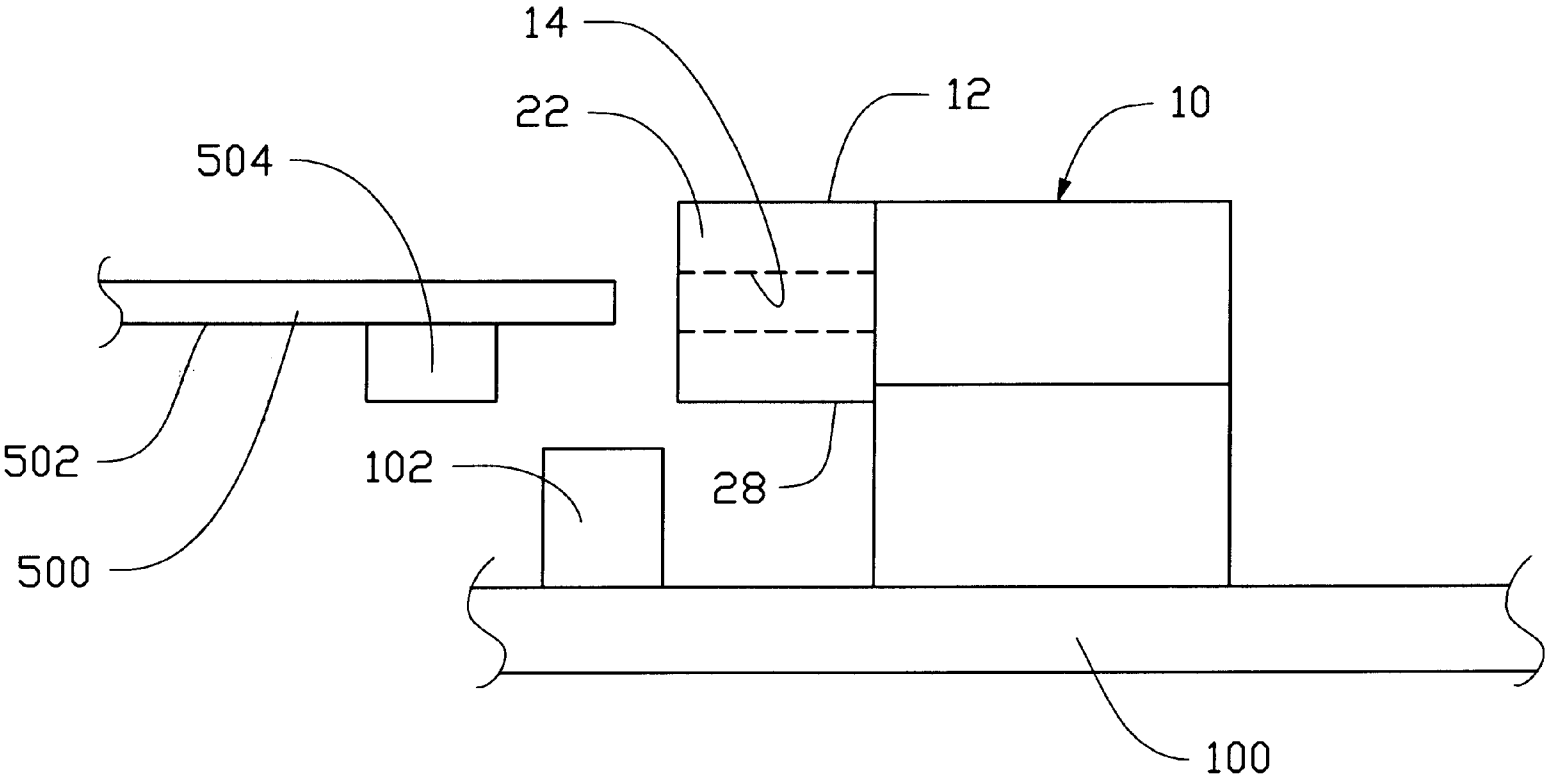
FIG. 6 is a side view of the connector of FIG. 2 with a module received therein and a PC board therebelow.

The shell 70 includes a vertical wall 72 and a horizontal wall 74 to form the L-shaped cross-sectional configuration. The shell 70 is generally seated on the end blocks 20 and the auxiliary block 40 wherein the horizontal wall 74 abuts against the top edges 81 of the blocks 20, 40, and the vertical wall 72 abuts against the back edges 80 of the blocks 20, 40. To guide the shell 70 to be attached to the blocks 20, 40 of the housing 12, the vertical wall 72 includes an alignment post 75 extending forward for reception within a corresponding slot 82 in the auxiliary block 40. To fasten the shell 70 to the blocks 20 of the housing 12, a pair of latches 76 extend forward from two end edges 78 of the vertical wall 72 for latchable engagement within a pair of cavities 84 provided in the respective end blocks 20. Referring to FIG. 5, a step 85 is formed in the cavity 84 for locking the inserted hook section 86 of the latch 76 thereof.

Therefore, after the contacts 18 have been assembled into the corresponding passageways 16, respectively, the spacer 32 is, by means of the shallow members 34, retainably attached to the bottom portion 38 of the blocks 20, 40 for having the tips 29 of the contact tails 30 restrained within the corresponding holes 31 of the spacer 30 for maintaining the true positions thereof, and also the shell 70 is fastened to the blocks 20, 40 of the housing 12 from the back wherein the alignment post 75 is guidable inserted into the corresponding slot 82 and the latches 76 are received within the cavities 84 with latchable engagement with the steps 85 in the cavity 84 by its hook sections 86. Understandably, the shell 70 can hardly be released from the housing 12 once having been attached thereto. It is different from the prior art connector having the metal shell, for both shielding and grounding consideration, attached to the housing by means of barbs in an interference fit. Oppositely, the invention uses a light and inexpensive plastic shell with resilient latches 76 for being adapted to be dedicatedly inserted into the cavities 84 while immovably and firmly fixed therein by engagement with steps 84 in the cavity.

It is noted that the invention provides a practical inexpensive shell 70 to firmly protectively enclosing the contact tails 30 within the whole connector assembly 10, so that the contact tails 30 are hardly tilted by the external impact. Moreover, referring to FIG. 6, the main body 22 of the housing 12 is spaced from the PC board 100 by the blocks 20, 40 and standoffs 52, thus providing an additional space between the horizontally inserted module 500 and the PC board 100. Accordingly, the components 102 on the PC board 100 and the components 504 on the under-surface 502 of the inserted module 100 will not interfere with each other.

Figure 7A:
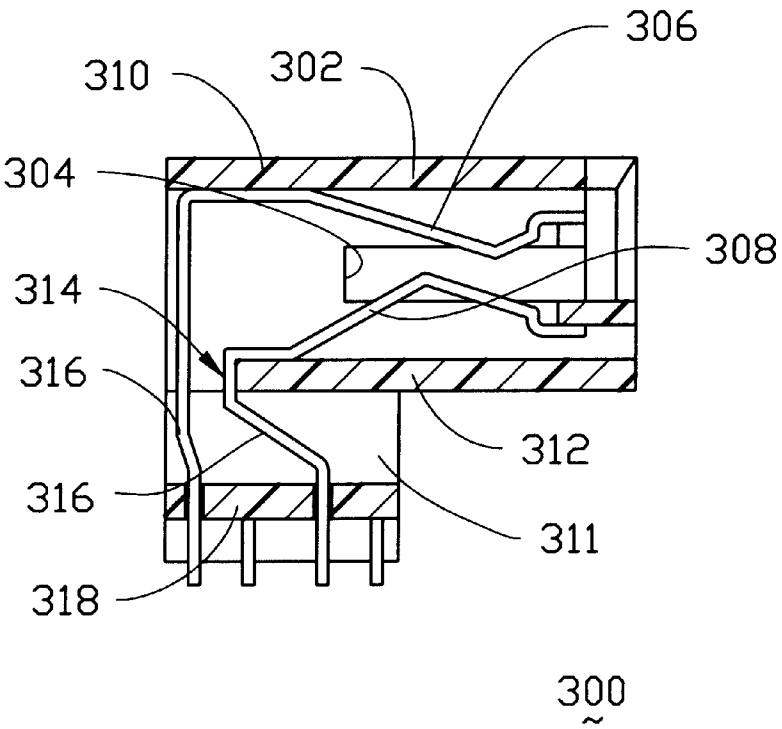
FIG. 7(A) is a cross-sectional view of a connector of a second embodiment according to the invention, along a pair of upper row contact and lower row contact.
Figure 7B:
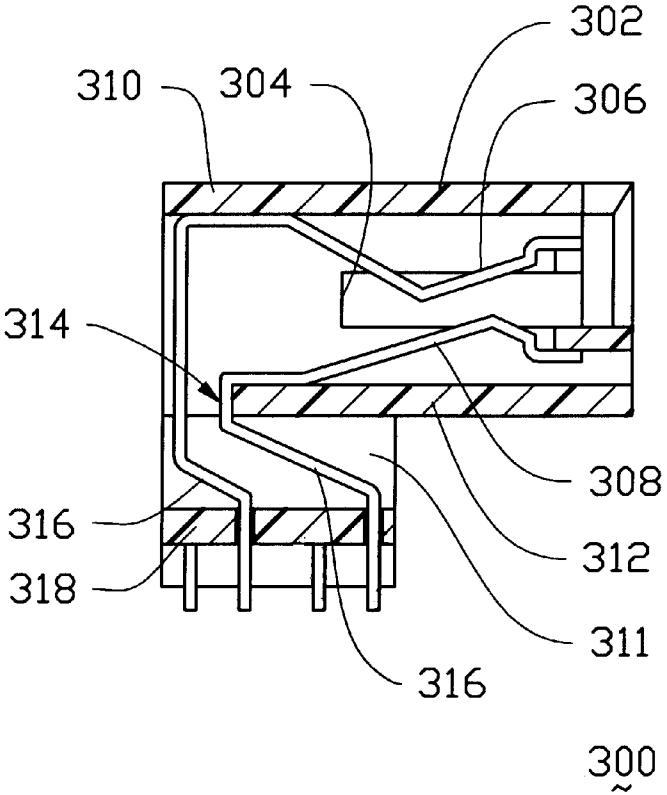
FIG. 7(B) is another cross-sectional view of the connector of FIG. 7(A), along an adjacent pair of upper row contact and lower row contact to those in FIG. 7(A).

FIGS. 7(A) and 7(B) shows another embodiment of the invention wherein the horizontal type card edge connector 300 includes a housing 302 defining a central slot 304 for receiving a module (not shown). An upper row of contacts 306 and a lower row of contacts 308 are positioned by two sides of the central slot 304. A cut-off is formed on the rear portion of the lower wall 312 and thus the upper wall 310 of the housing 302 is longer than the lower wall 312 of the housing 302. In other words, a space 314 is provided behind the lower wall 312 of the housing 302 for allowing the contact tails 316 of the upper row of contacts 306 and of the lower row of contacts 308 to extend downward. Based on this structure, a spacer 318 between two opposite end blocks 311, is substantially disposed under the upper wall 310 and the lower wall 312 of the housing, i.e., not behind the rear portion of the housing 302. Under this situation, the contact tails 316 of either the upper row of contacts 306 or the lower row of contacts 308 have to extend angularly forward. Certainly, the whole connector assembly 300 occupies less area on the PC board layout in comparison with that in the first embodiment.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for mounting on a PC board, comprising:

an insulative elongated housing defining a central slot for horizontally receiving a module therein;

two rows of contacts disposed by two sides of the central slot with contact tails extending out of the housing;

a pair of end blocks extending rearward and downward at two opposite ends of the housing defining a first space therebetween for accommodating said contact tails; and a shell disposed on a rear portion of the housing and supportably seated on the end blocks with means for fastening the shell to end blocks, the shell having an alignment post extending forward from the vertical wall for receiving a corresponding slot in an auxiliary block positioned between said two end blocks.

2. The connector as defined in claim 1, wherein a spacer is provided around bottom portions of the end blocks and those of the auxiliary block.

3. The connector as defined in claim 1, wherein two standoffs extend downward from a bottom surface of the housing for providing additional even support corresponding to the two end blocks.

4. The connector as defined in claim 3, wherein a spacer is provided around bottom portions of the end blocks and of the auxiliary block, and a front edge of the spacer confronts the standoffs.

5. The connector as defined in claim 2, wherein the spacer abuts against an under-surface of the auxiliary block and retained between the two end blocks within two shallow members of the end blocks.

6. An electrical connector for use with a PC board, comprising:

an insulative elongated housing defining a horizontally extending central slot for receiving a module therein;

two rows of contacts disposed on two sides of the central slot;

two end blocks extending rearward adjacent to two opposite ends of the housing, respectively;

a spacer attached to a space defined between said two end blocks; and an auxiliary blocks disposed between said two opposite end blocks and defining an under-surface against which the spacer abuts.

7. The connector as defined in claim 6, wherein at least one standoff extends downward from a bottom surface of the housing against which a front edge of the spacer abuts.

8. An electrical connector for mounting on a PC board, comprising:

an insulative elongated housing defining a central slot for horizontally receiving a module therein;

two rows of contacts disposed by two sides of the central slot with contact tails extending out of the housing;

a pair of end blocks extending rearward and downward at two opposite ends of the housing defining a first space therebetween for accommodating said contact tails; and a shell disposed on a rear portion of the housing and supportably seated on the end blocks with means for fastening the shell to end blocks, the shell having a vertical wall and a horizontal wall commonly defining an L-shaped cross-sectional configuration, said fastening means being a pair of latches extending from the shell for latchable engagement with step members formed in each end block for fastening the shell to the housing.

9. An electrical connector for mounting on a PC board, comprising:

an insulative elongated housing defining a central slot for horizontally receiving a module therein;

two rows of contacts disposed by two sides of the central slot with contact tails extending out of the housing;

a pair of end blocks extending rearward and downward at two opposite ends of the housing defining a first space therebetween for accommodating said contact tails;

a shell disposed on a rear portion of the housing and supportably seated on the end blocks with means for fastening the shell to end blocks; and two standoffs extending downward from a bottom surface of the housing for providing additional even support corresponding to the two end blocks.

10. An electrical connector for mounting on a PC board, comprising:

an insulative elongated housing defining a central slot for horizontally receiving a module therein;

two rows of contacts disposed by two sides of the central slot with contact tails extending out of the housing;

a pair of end blocks extending rearward and downward at two opposite ends of the housing defining a first space therebetween for accommodating said contact tails;

a shell disposed on a rear portion of the housing and supportably seated on the end blocks with means for fastening the shell to end blocks;

a spacer provided around bottom portions of the end blocks and the auxiliary block, abutting against an under-surface of the auxiliary block and retained between the two end blocks within two shallow members of the end blocks.

* * * * *